US006236350B1

(12) United States Patent
Andrews

(10) Patent No.: US 6,236,350 B1
(45) Date of Patent: May 22, 2001

(54) UNIVERSAL REMOTE CONTROL CODE IDENTIFICATION SYSTEM

(75) Inventor: Nathan William Andrews, Emmaus, PA (US)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/148,209

(22) Filed: Sep. 4, 1998

Related U.S. Application Data

(60) Provisional application No. 60/057,934, filed on Sep. 5, 1997.

(51) Int. Cl.[7] ..... G08C 19/12

(52) U.S. Cl. ..... 341/176; 341/175; 359/148; 340/825.69

(58) Field of Search ..... 341/175, 176; 359/146, 148; 455/151.4; 340/825.22, 825.69, 825.72; 345/169

(56) References Cited

U.S. PATENT DOCUMENTS 4,412,218 * 10/1983 Niitsu ..... 341/176
4,703,359 * 10/1987 Rumbolt et al. ..... 340/870.72
4,746,919 * 5/1988 Reitmeier ..... 340/825.72
5,614,906 * 3/1997 Hayes et al. ..... 341/176

* cited by examiner

*Primary Examiner*—Michael Horabik
*Assistant Examiner*—Timothy Edwards, Jr.
(74) *Attorney, Agent, or Firm*—Joseph S. Tripoli; Paul P. Kiel

(57) ABSTRACT

A remote control apparatus and a method for identifying a reference code stored in a remote control apparatus. The remote control apparatus stores a reference code associated with a particular electronic device to be controlled and allows the user to determine the stored reference code by entering a code identification mode. In the code identification mode, the user selects a sequence of keys on the keypad and observes an indicator, such as an LED, after each key selection. The indicator is activated by a control unit when the number selected corresponds to the first digit in the reference code. The user then selects another sequence of keys on the keypad and observes the indicator after each key selection to identify the next digit in the reference code. The user repeats these steps to sequentially identify all of the digits in the reference code.

12 Claims, 4 Drawing Sheets

UNIVERSAL REMOTE CONTROL CODE IDENTIFICATION SYSTEM

This application claims the benefit of U.S. Provisional Application No. 60/057,934, filed on Sep. 5, 1997.

BACKGROUND OF THE INVENTION

1. Field of the Invention.

The present invention relates to remote controls for operating electronic devices, and more particularly to universal remote controls which can be programmed by a user to operate one of a plurality of different types of electronic devices produced by different manufacturers.

2. Related Art.

Universal remote controls are well known devices which can be programmed by a user to operate one of a plurality of different types of electronic devices produced by different manufacturers. Universal remote controls are often used to control audio/video equipment, such as TVs, VCRs, CD players and the like. Due to their programmability, consumers frequently use universal remote controls to replace lost remote controls and as a single control device for controlling a number of separate audio/video components.

Typically, a universal remote control is programmed by entering a reference code associated with an electronic device to be controlled into a memory device of the universal remote control. The reference code identifies, the electronic device type and manufacturer and allows the universal remote control to transmit control signals having the proper signal structure to the device to be controlled. The proper signal structure is determined by characteristics which include, but are not limited to, carrier frequency, pulse width, pulse modulation and overall timing.

Several methods are available for entering a reference code into a universal remote control. One method is the direct, manual entry method. In such a method, a list of reference codes for a variety of popular device models is included in the printed instruction set that accompanies the universal remote control. The user finds the reference code associated with the device to be controlled and manually enters the code numbers using a numeric keypad disposed on the universal remote control. This method can be problematic for the user because the specific code numbers must be known in order to program the universal remote control. Thus, the reference code list must be kept nearby and consulted each time the code must be reentered or a new code needs to be entered.

Another method of entering a reference code is a semi-automatic automatic code search method in which the user steps through a plurality of reference codes stored in the universal remote control until the desired code is found. In this method, the user steps through the set of stored reference codes one at a time by pressing a designated control button, sends a control signal after each step and observes whether the device reacts in the desired manner, i.e., power ON/OFF. When the device reacts to the signal in the expected manner, the user knows that the correct reference code has been identified and uses another keystroke sequence, for example, an ENTER button, to terminate the code search and store that reference code into the memory device of the remote control. A difficulty with this method is that the user may be forced to go through a large number of steps, and therefore keystroke combinations, before finding the correct reference code because there may be a large number of reference code possibilities. Also, even though this method will determine and store the desired reference code, the user does not know the specific reference code numbers. Thus, if the reference code is stored in volatile memory and power is lost or if the user wishes to program another universal remote for the same device, the user must repeat the same code search sequence.

Another method of entering and storing a reference number is an automatic code searching method wherein the universal remote control automatically cycles through a list of reference codes and sends a control signal to the device for each reference code when a user initiates a code search sequence. When the device reacts to the control signal in the desired manner, the user terminates the code search sequence, for example, by pressing or releasing a designated button, thereby storing the correct reference code into the universal remote control. Again, the reference code is automatically stored into the remote control and the user does not know the reference code numbers.

As noted above, it may be desirable for a user to know the reference code numbers in the event that the user needs to reprogram the remote control or wishes to program other remote controls to operate the same device. However, it may be difficult to determine the reference code numbers after the reference code has been programmed into the remote control using the automatic or semi-automatic programming methods described above.

One code identification method allows a user to determine the code numbers by counting a blinking sequence on a set of LEDs and matching the count sequence with a reference table in a printed instruction set. However, this method becomes inconvenient if the blinking sequence occurs too quickly and the user is forced to repeat the process several times in order to obtain the correct count sequence. Further, this method still requires the user to refer to a printed list.

SUMMARY OF THE INVENTION

Therefore, what is needed is an improved method of programming a universal remote control with a particular reference code without referring to a printed list of reference codes and quickly and easily identify the stored reference code numbers.

The present invention involves a universal remote control which allows a user to easily program a reference code into a memory device and then identify the stored reference code numbers. A user may program the universal remote control using direct entry or some form of automatic or semi-automatic code searching methods. Once a reference code has been stored in the universal remote control, the present method allows a user to easily and quickly determine the numbers in the reference code by pressing each of the number buttons on the remote control keypad one at a time and observing the status of an indicator disposed on the remote control after each button press. In an exemplary embodiment, an indicator LED lights up when the number button associated with the correct digit in the code sequence is pressed. As the status of the LED or indicator can be determined each time a particular number button is pressed, the user can go at a comfortable pace and is not required to count a blinking sequence or refer to a printed list.

BRIEF DESCRIPTION OF THE DRAWINGS

The invention will be described with reference to the accompanying drawings, wherein.

DETAILED DESCRIPTION OF AN EXEMPLARY EMBODIMENT

Figure 1:
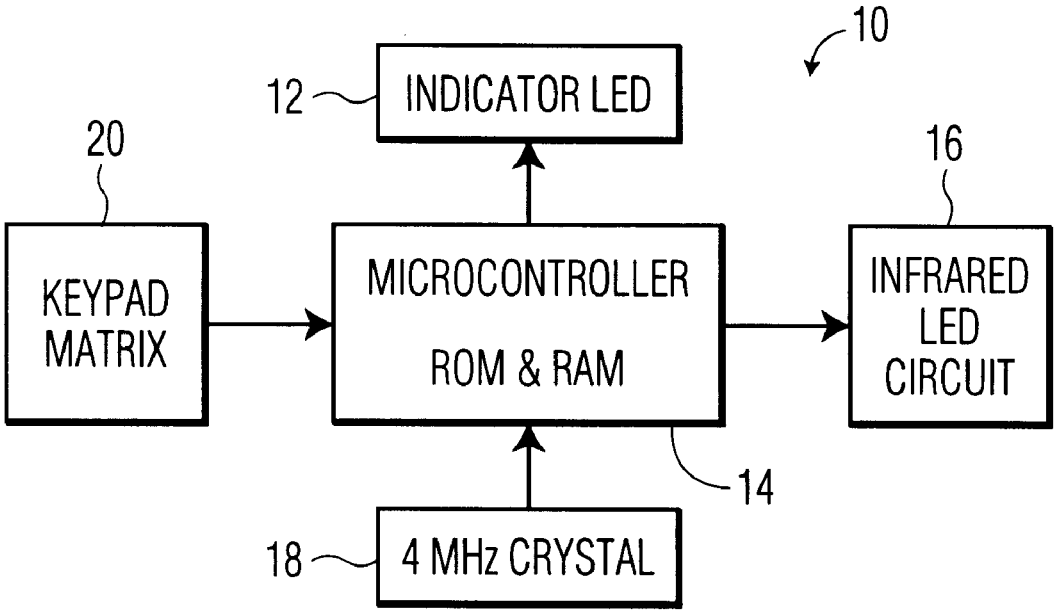
FIG. 1 is a simplified block diagram of the elements in a universal remote control.

Referring to FIG. 1, there is shown a simplified block diagram of a universal remote control 10. The elements within universal remote control 10 and their operation in generating and transmitting control signal for controlling an electronic device are known in the art and will not be discussed in detail here.

Generally, user input is received through keypad matrix 20 which includes various control buttons, device selection buttons, numerical buttons and the like. Microcontroller 14 receives the user input, generates an appropriate signal having the required signal structure and controls infrared LED circuit 16 to send a control signal to the device to be controlled. Upon receiving a user input from keypad matrix 20, microcontroller 14, based on the designated reference code, looks up the desired information stored in the RAM and/or ROM to identify and generate the correct signal structure from the product code look up tables, including the proper carrier frequency, pulse width, pulse modulation and overall signal timing information. It is to be understood that the RAM and ROM may be either internal or external to microcontroller 14. The control signal is transmitted through infrared LED circuit 16. Microcontroller 14 also lights up indicator LED 12 to indicate that a control signal has been transmitted. Indicator LED 12 may also be lit up as required during the code search and/or code identification procedures as described further below. The timing of microcontroller 14 is controlled by crystal oscillator 18.

Figure 3:
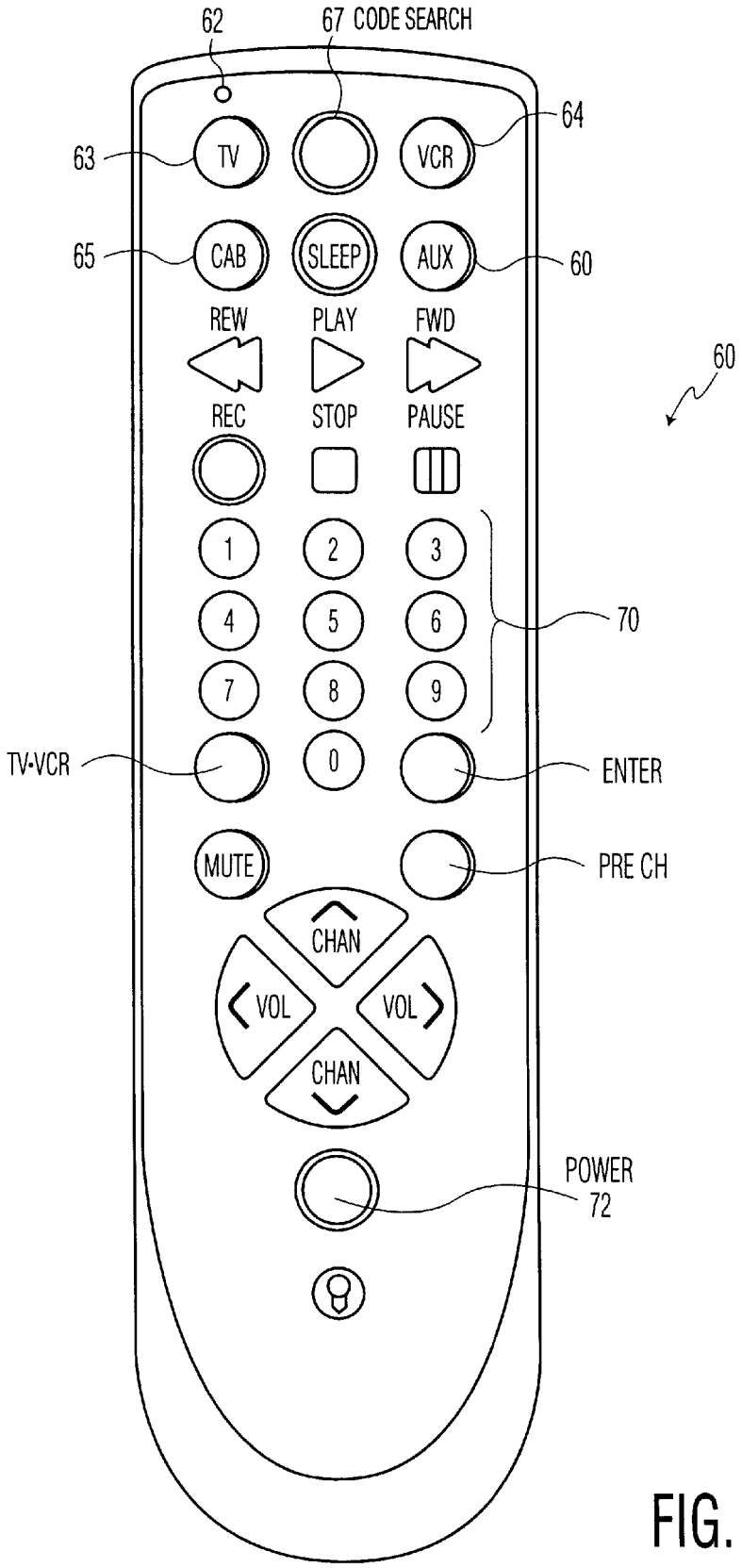
FIG. 3 is a top plan view of a universal remote control suitable for implementing the present code identification method.

A universal remote control which includes a numeric and control button keypad layout suitable for use with the present code identification method is illustrated in FIG. 3. Universal remote controls which generally include the elements described above and a suitable keypad layout include, but are not limited to, RCU 330, 402, 4GLW, 1300, 1400, SAT1 and SAT2 manufactured by THOMSON CONSUMER ELECTRONICS of Indianapolis, Ind. As shown in FIG. 3, universal remote control 60 includes LED 62 which provides indication of various operations, for example, code searching and code identification, and keypad entry. Remote control 60 also includes numeric keypad 70, a plurality of device buttons 63–65 for selecting the device to be controlled by remote control 60 and CODE SEARCH button 67 for initiating the code search and code identification procedures. Power button 72 is used to turn a selected device ON and OFF, and may also be used in the code search procedure to provide an indication as to when the desired reference code has been found.

Universal remote control 60 may incorporate the direct, manual entry method, the semi-automatic stepping entry method, the automatic entry method, or any other suitable method of selecting and entering a reference code. Additionally, present universal remote control 60 also incorporates a simple, user friendly method of identifying the reference code numbers stored in universal remote control 60.

The present code identification method is now described. First, the user initiates the code identification sequence by pressing a particular button combination. For example, in universal remote control 60, the user presses CODE SEARCH button 67 until indicator LED 62 remains lit then releases CODE SEARCH button 67. Second, the user presses one of the device buttons 63–65 corresponding to the device to be controlled. Indicator LED 62 blinks once after the user presses a device button to acknowledge the user's selection. The user then presses CODE SEARCH button 67 a second time to turn OFF indicator LED 62 and begin checking for the specific reference code numbers. At this point, the user presses each of the number buttons on the keypad one at a time and checks indicator LED 62 after each button press. The number which cause indicator LED 62 to blink is the first digit of the reference code. After identifying the first digit, the user repeats the process to identify each of the remaining digits of the reference code.

Figure 2A:
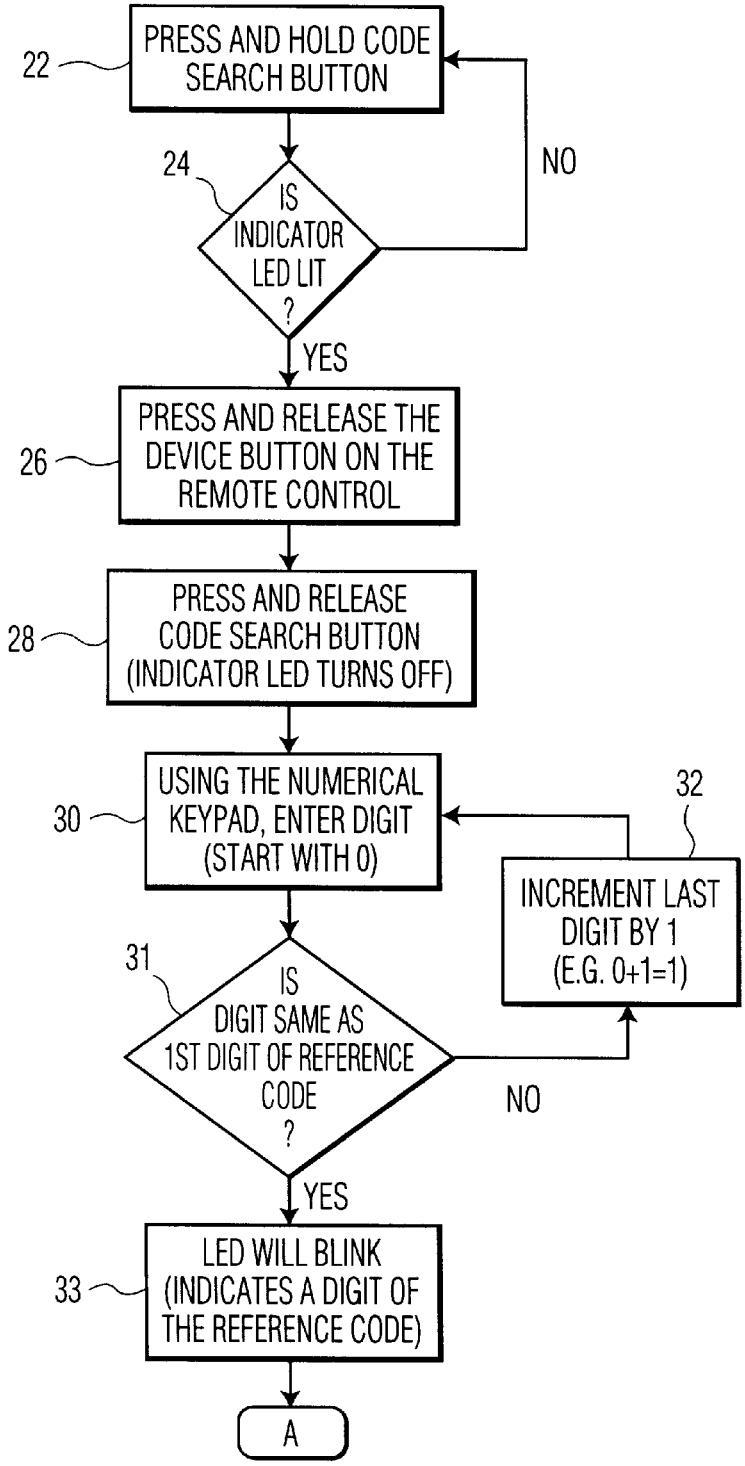
FIGS. 2A–B are flowchart diagrams showing the steps for identifying a reference code according to the present code identification method.
Figure 2B:
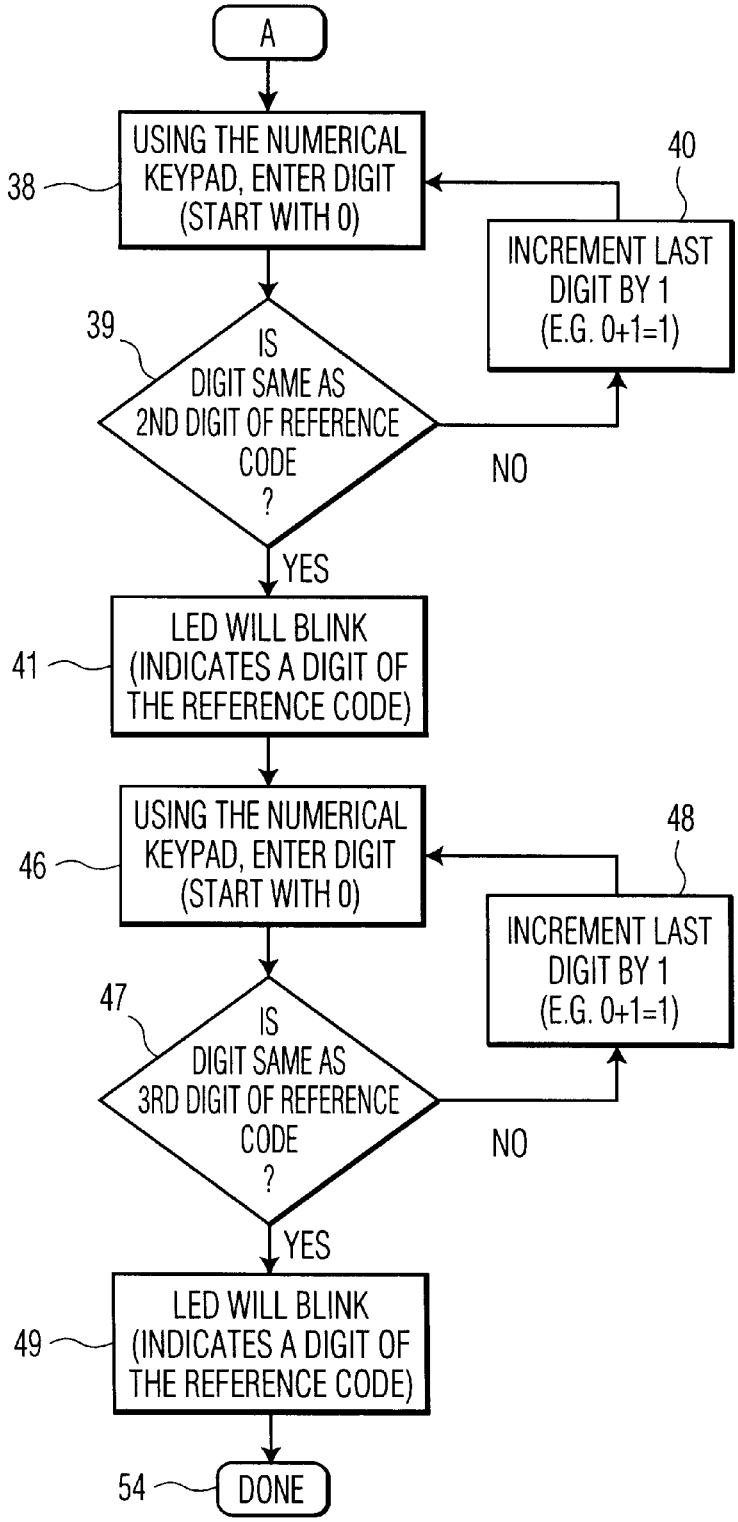

The present method for identifying the reference code numbers is shown in flowchart form in FIGS. 2A–B. In step 22, the user initiates the code identification procedure by pressing and holding CODE SEARCH button 67 until indicator LED 62 lights up. The user then releases CODE SEARCH button 67 and presses and releases one of the device buttons 63–65 in step 26 to indicate whether the code identification is to be performed for a television, VCR or cable box. The CODE SEARCH button 67 is pressed and released a second time in step 28 to begin identifying the reference numbers and indicator LED 62 turns OFF.

In steps 30–33, the user presses each of the number buttons one at a time, starting with zero, until indicator LED 62 blinks. A blink of indicator LED 62 at step 33 indicates that the user has pressed the correct number button corresponding to the first digit of reference code number. The user then begins searching for the next number. In steps 38–41 and 46–49, the user repeats steps 30–33 to determine the second and third digits in the reference code. Although the present description relates to a three digit code, it is to be understood that the digit identification sequence may be repeated as many times as necessary to determine all of the digits in a particular reference code.

It is clear that the present code identification method allows the user to proceed at the user's pace rather than having to count a series of blinks on an LED array. Since the user presses each of the number buttons and then checks for a response, in this case a blink of an LED, the user controls the rate at which each of the possible numbers are checked. Therefore, the user does not have to worry about keeping pace with a blinking LED sequence.

It is to be understood that the present method may be implemented using a number of techniques and/or programming languages known to one of ordinary skill in the art, including, but not limited to programming a microcontroller using assembly language, C and C++.

It will be apparent to those skilled in the art that although the invention has been described in terms of a specific example, modifications and changes may be made to the disclosed embodiment without departing from the essence of the invention. For example, the indicator function may be provided with several LED's of differing colors or with a series of audio beeps. Therefore, it is to be understood that the present invention is intended to cover all modifications which naturally flow from the foregoing and example.

What is claimed is:

1. In a remote control apparatus having a reference code associated with a particular control signal format stored therein, the reference code comprising a sequence of code symbols, a method for identifying a particular sequence of code symbols, comprising the steps of:

providing a plurality of input keys on the remote control apparatus and an indicator, each input key representing a particular code symbol;

activating a code identification mode;

selecting one of the plurality of input keys and observing the indicator after the input key selection, the indicator being activated when a code symbol represented by a selected input key corresponds to a desired code symbol in the particular sequence of code symbols;

identifying the desired code symbol by repeating the selecting and observing step until the indicator is activated; and repeating the selecting, observing and identifying steps for determining each code symbol in the particular sequence of code symbols.

2. The method according to claim 1, wherein said providing step comprises providing a numeric keypad on the remote control apparatus.

3. The method according to claim 1, wherein said providing step comprises providing one of a visual and audible indicator on the remote control apparatus.

4. The method according to claim 1, wherein said activating step comprises activating a code identification mode by selecting a particular sequence of input keys.

5. The method according to claim 1, wherein said providing step comprises providing a device key for selecting one of a plurality of stored reference codes, each reference code associated with a particular electronic device, to be used in generating remote control signals, and said activating step comprises activating a code identification mode to identify a selected one of the plurality of stored reference codes.

6. A remote control apparatus, comprising:

an input unit comprising a plurality of input keys, each said input key representing a particular code symbol;

an indicator unit;

a transmitter unit;

a memory having a reference code associated with a particular control signal format stored therein, said reference code comprising a sequence of code symbols, and a control unit for causing said transmitter unit to transmit a control signal in accordance with said reference code in response to a user input, said control unit operating in a code identification mode of operation for allowing user to sequentially identify each code symbol of said reference code in response to a sequence of user input key selections, wherein said control unit controls said indicator unit in response to a user input key selection by activating said indicator unit when a code symbol represented by a user selected input key corresponds to a desired code symbol in said sequence of code symbols, said sequence of user input key selections being repeated to determine each code symbol in the sequence of code symbols.

7. The apparatus according to claim 6, wherein said input unit comprises a numeric keypad.

8. The apparatus according to claim 6, wherein said reference code comprises a three digit numeric code associated with a particular electronic device.

9. The apparatus according to claim 6, wherein said reference code comprises a plurality of reference codes, each said reference code being associated with a particular type of electronic device.

10. The apparatus according to claim 9, wherein said input unit comprises a device key for configuring said control unit to transmit control signals associated with a selected one of said reference codes.

11. The apparatus according to claim 9, wherein said indicator unit comprises one of a visual and audible indicator.

12. The apparatus according to claim 9, wherein said memory is incorporated into said control unit.

* * * * *